US012108883B2

(12) United States Patent
Skochenski

(10) Patent No.: US 12,108,883 B2
(45) Date of Patent: Oct. 8, 2024

(54) PORTABLE AND COMPACT SEAT COVER AND USER PROTECTOR

(71) Applicant: Julie Skochenski, Lino Lakes, MN (US)

(72) Inventor: Julie Skochenski, Lino Lakes, MN (US)

(73) Assignee: Julie Skochenski, Lino Lakes, MN (US)

( * ) Notice: Subject to any disclaimer, the term of this patent is extended or adjusted under 35 U.S.C. 154(b) by 0 days.

(21) Appl. No.: 17/863,161

(22) Filed: Jul. 12, 2022

(65) Prior Publication Data

US 2023/0320493 A1 Oct. 12, 2023

Related U.S. Application Data

(60) Provisional application No. 63/330,116, filed on Apr. 12, 2022.

(51) Int. Cl.
*A47C 31/11* (2006.01)

(52) U.S. Cl.
CPC ..... *A47C 31/113* (2013.01); *A47C 31/116* (2013.01)

(58) Field of Classification Search
CPC ..... A47C 31/113; A47C 31/116; A47C 31/11
USPC ..... 297/219.1
See application file for complete search history.

(56) References Cited

U.S. PATENT DOCUMENTS

| | | | | |
|---|---|---|---|---|
| 4,998,297 | A * | 3/1991 | Summerville | A47K 13/14 4/245.7 |
| 5,238,293 | A * | 8/1993 | Gibson | B62B 3/144 297/229 |
| 6,312,051 | B1 * | 11/2001 | Adams | A47C 31/113 297/228.11 |
| 7,207,627 | B2 * | 4/2007 | Jerome | A47C 31/02 297/DIG. 6 |
| 2007/0157355 | A1 * | 7/2007 | Katsin | B32B 5/245 442/76 |
| 2021/0401188 | A1 * | 12/2021 | Jones | A47C 31/113 |
| 2022/0211190 | A1 * | 7/2022 | Forte | A47C 31/11 |
| 2022/0312974 | A1 * | 10/2022 | Elkaim | A47C 7/622 |

FOREIGN PATENT DOCUMENTS

| | | | | |
|---|---|---|---|---|
| JP | H0679352 U | * | 11/1994 | |
| WO | WO-03045213 A2 | * | 6/2003 | A47K 13/14 |

* cited by examiner

*Primary Examiner* — Milton Nelson, Jr.
(74) *Attorney, Agent, or Firm* — Amanda M. Prose; Z. Peter Sawicki; Westman, Champlin & Koehler, PA.

(57) ABSTRACT

A portable, compactable seating barrier for positioning between a user and a seating surface and with a soft and/or moisture wicking material having a first and second side with one side comprising a non-slip texture on at least a portion thereof, and wherein the material has a first dimension that is in the range of approximately 18 inches to approximately 25 inches in length and a second dimension that is in the range of approximately 18 inches to approximately 25 inches in width and a thickness that is less than ⅓ inch.

9 Claims, 4 Drawing Sheets

PORTABLE AND COMPACT SEAT COVER AND USER PROTECTOR

CROSS-REFERENCE TO RELATED APPLICATION

This application claims priority to U.S. provisional patent application Ser. No. 63/330,116, filed Apr. 12, 2022, the contents of which are incorporated herein in their entirety.

BACKGROUND

The present invention relates to a protective device for positioning between a user and a seat. The device can be used to protect a user's skin and/or clothing from the seating.

Portable seat cushions are clunky, uncomfortable, thick, heavy, not compact and generally made of a material that scratches or sticks to a user's bare skin as these seat cushions are made for cleaning via wiping or rinsing.

In hot summer months, on sunny days, or when wearing shorts, dresses, or swimsuits, it can be uncomfortable to sit on outdoor furniture. Car seats may likewise be hot and sticky when a car is parked in the sun. Conversely, in cooler conditions, car seats may be cold. Additionally, outdoor furniture may be hot, cold, sticky, or on some days wet from rain or morning dew. Additionally, public seating may be infrequently cleaned, unsanitary, or damaged which can irritate a user's skin or soil their clothing. A user's skin may also "stick" to the seat. Most women resort to sitting on an excess item of clothing such as a sweater or light jacket to protect themselves from uncomfortable seating.

SUMMARY

An aspect of the present disclosure relates to a portable and compactable seating barrier. What is meant by "compactable" as used herein is a seating barrier that is foldable, rollable, or otherwise capable of being scrunched or crumpled such that the barrier can be reduced in foot print and size without damage to the barrier. The barrier is a soft, non-irritating material and in some embodiments may also be a moisture wicking or absorbent material. The barrier has a first and second side wherein at least one of the of first or second sides comprises a non-slip texture on at least a portion thereof, and wherein the material has a first dimension that is in the range of approximately 18 inches to approximately 25 inches in length and a second dimension that is in the range of approximately 18 inches to approximately 25 inches in width and a thickness that is less than one inch.

The seating barrier is less than ½ inch thick.

The non-slip texture comprises silicon.

The second side comprises the non-slip texture on approximately 1% to approximately 100% of a surface area of the second surface.

The second side comprises the non-slip texture on approximately 25% to 75% of the surface area of the second side.

The seating barrier is rectangular or square in overall shape and comprises smooth edges and rounded corners.

The material is microfiber.

The non-slip texture is printed in a spaced apart repeating pattern such that the second side of the seating barrier has a non-flat surface topography.

Another aspect of the present disclosure relates to a skin and clothing protector comprising a microfiber material having a non-flat back side for contacting a seating surface and a front side for contacting a user's skin and/or clothing wherein the protector has dimensions sufficient to cover a surface area of the seating surface and wherein the protector is foldable to reduce the area of the protector by at least ⅓ for compact stowage.

The non-flat back side comprises one or more areas of non-slip material configured to increase a co-efficient of friction between the microfiber material and the seating surface wherein the seating surface is comprised of metal, wood, plastic, leather, or combinations thereof.

The skin and clothing protector is machine washable for re-use.

The protector prevents the user's skin or clothing from contacting the seating surface.

DETAILED DESCRIPTION

Figure 1:
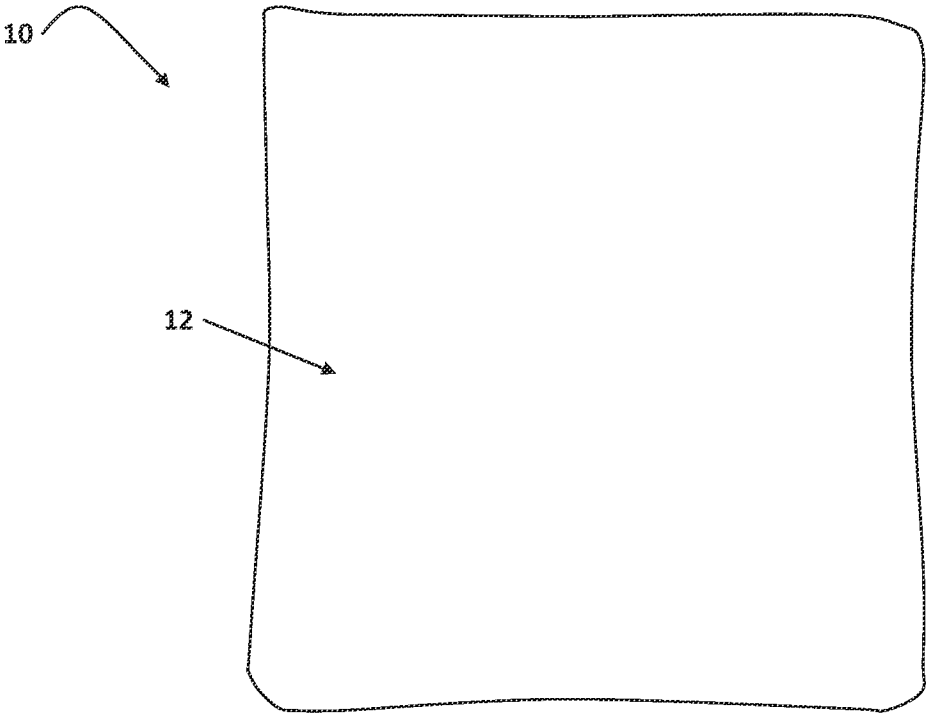
FIG. 1 is a front view of a portable, foldable and washable seating surface barrier.
Figure 2:
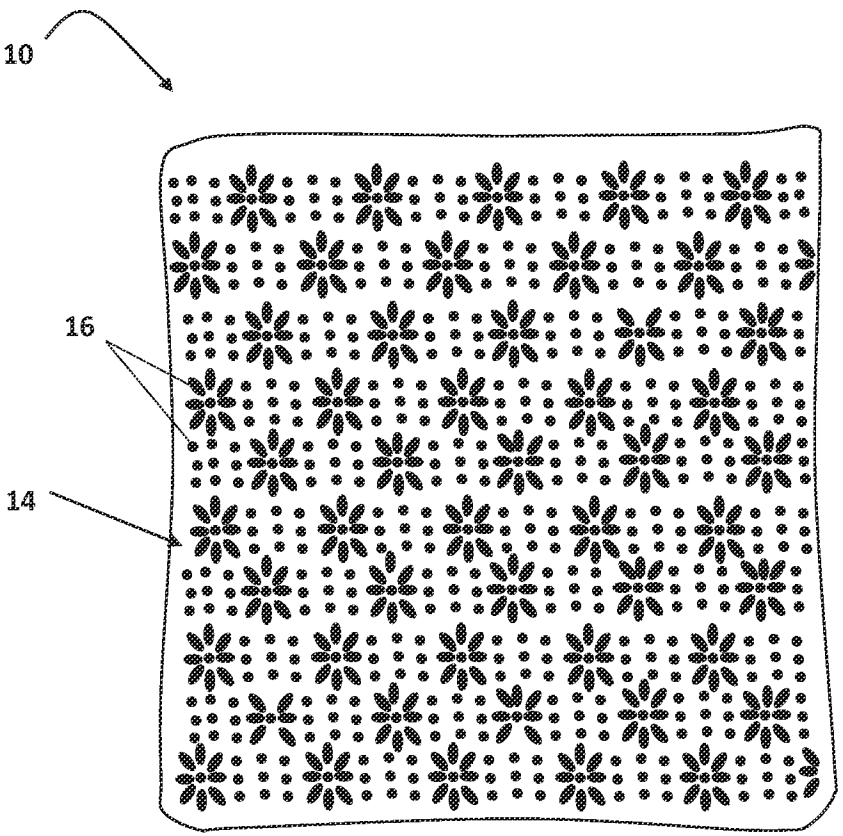
FIG. 2 is a rear view of a portable, foldable and washable seating surface barrier.
Figure 4:
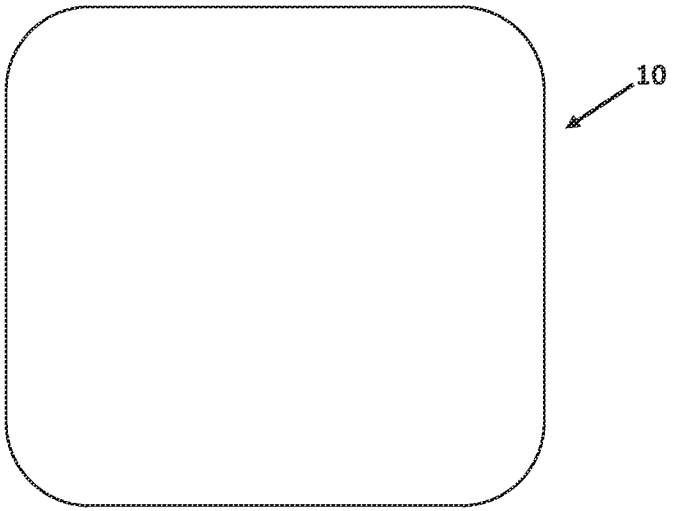
FIG. 4 is another front view of the seating surface barrier.
Figure 5:
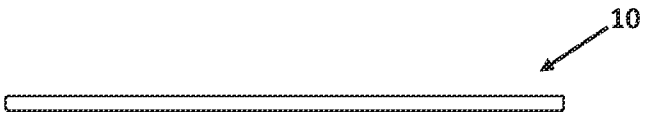
FIG. 5 is a side view of the seating surface barrier.
Figure 3:
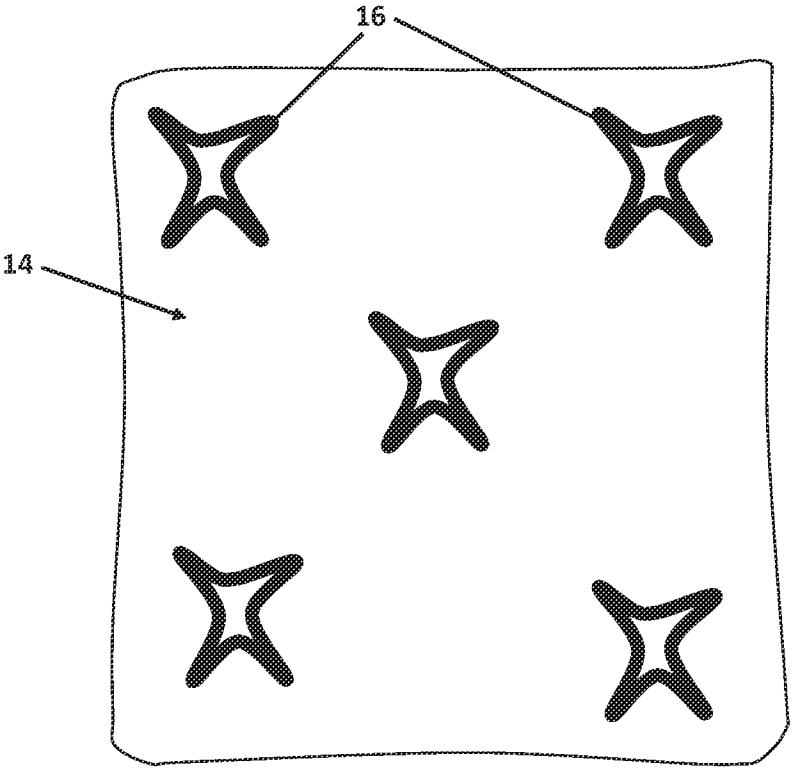
FIG. 3 is a rear view of a portable, foldable and washable seating surface barrier.

A seating surface described herein is a soft surface configured to protect a user's bare skin and/or clothing from sticky, dirty, sweaty, hot, cold, or otherwise undesirable seating surfaces such as chairs, benches, seats, or bleachers. The seating surface increases comfort in temporary seating and also prevents a user's exposed skin from sticking to vinyl, leather, plastic, metal, wicker and wood surfaces. The surface may also reduce discomfort from metal surfaces sitting in direct sunlight, uneven surfaces or weathered surfaces. The seating surface may also reduce an imprint that would otherwise be left on a user's exposed skin when sitting on patterned chair seats such as those constructed from wicker or metal.

The seating surface is portable, foldable and stowable in a bag or pouch. The seating surface is also provided with a non-slip texture on at least a portion of one side of the seating surface.

The seating surface comprises a first side and a second opposing side, where the first side is a soft fabric side, and the second side comprises one or more areas having an increased co-efficient of friction. In one embodiment, the seating surface comprises a microfiber material thus providing a microfiber texture on the first side and a non-slip texture at one or more locations on the second side. This allows the seating surface to remain in selected position on a chair, bench or other seat, chair or bench while providing a soft, moisture wicking surface on the opposing side.

The second side having the non-slip contact points thereon is configured for placement in contact with the support surface or seat of a chair, bench, bleacher or other surface while the opposing side is an upright side for contact with the user's clothing and/or exposed skin.

The seating surface described herein is provided for placement and use between a user and a support surface or seat of a chair, bench, bleacher or other seating location, including but not limited to ground surfaces.

The seating surface described herein may also keep dirt, sweat, stains and/or germs off of the user's skin as it provides a barrier between the user and the seat. Thus, the user has a degree of reassurance from the seating surface as the user contacts a known surface with use of the seating surface.

The seating surface described herein is machine washable and reusable.

The seating surface has a thickness that may be less than one inch, less than ½ inch, less than ¼ inch, less than ⅛ inch thick, or less than approximately 1/16 inch thick. This allows the seating surface to be compactly folded once, twice, three, or four or more times for storage in a compact and portable pouch. The seating surface may also be rolled and/or scrunched for storage in the compact carry pouch and be easily unfolded, unfurled and/or otherwise spread out for use.

The seating surface may also comprise a hemmed, sewn, sealed, and/or otherwise finished perimeter edge and the seating surface may further comprise one or more apertures for connecting to a clip or other fastener for hanging, drying and/or carrying with or without a storage or transport pouch. For example, the seating surface and/or pouch may be configured for connection with a clip such as a carabiner clip, snap, clasp, hook and loop, and other fasteners.

The seating surface may be provided with a footprint having any geometric shape as defined by the perimeter. In one embodiment, the seating surface has a first dimension that is a width in the range of approximately 18 inches to approximately 25 inches and a second dimension that is a length in the range of approximately 18 inches to approximately 25 inches. The size of the seating surface may be increased or decreased for different end users, which in addition to adults, include children and pets. The thickness of the seating surface is then in the range of approximately 1/32 inch to approximately ½ inch or more. In one embodiment, the seating surface is approximately 1 mm thick. This allows the seating surface to be folded down to a size where the width and length and each less than about 6 inches or even less than about 3 inches, allowing for insertion into a small pouch for compact storage and/or transport.

The seating surface may be used to provide a barrier between a user and a seating surface that may include but is not limited to patio chairs, bleachers, restaurant seating, park benches, barstools, boat seats, work out equipment, beach chairs, airplane seats, vehicle seats (leather and other), public transportation seating, sporting event seating, in golf carts as well as clinic, office, and hospital seating areas. The seating surface can be equally enjoyed by outdoor enthusiasts as well as germ-conscious users.

In one example embodiment illustrated in FIGS. 1-4 the seating surface barrier 10 is a reusable, washable seating surface where a first surface 12 for contacting a user is a soft, moisture wicking material such as microfiber or a like material surface. The seating surface barrier 10 is an approximately 22 inch×22 inch square with smooth edges and rounded corners. It is also contemplated that the seating surface 12 may be provided with stylish patterns and/or dark colors such as black to reduce the visibility of sweat stains or other dirt.

A second opposing side 14 of the seating surface 12 comprises one or more areas printed with a non-slip material 16 such as a silicone print or like material which provides a "grip" surface to the second side. Approximately 1% to 100% of the second side may be provided with the non-slip material. That is, there may be embodiments wherein the entire or substantially entire second side 14 is provided with non-slip texture 16. In one in embodiment, a plurality of locations are printed with the non-slip material 16 resulting an approximately 50% of the second side having areas of increased friction or grip. The areas of non-slip grip 16 on the second side 14 may be in any pattern, spaced patterns, shape(s), size(s), location(s) and/or orientation(s) and may include writing, logos, customized art, patterns, QR codes, or other designs. It is also contemplated and within the scope of this disclosure that the non-slip material 16 may be colored or clear.

Figures 6, 7:
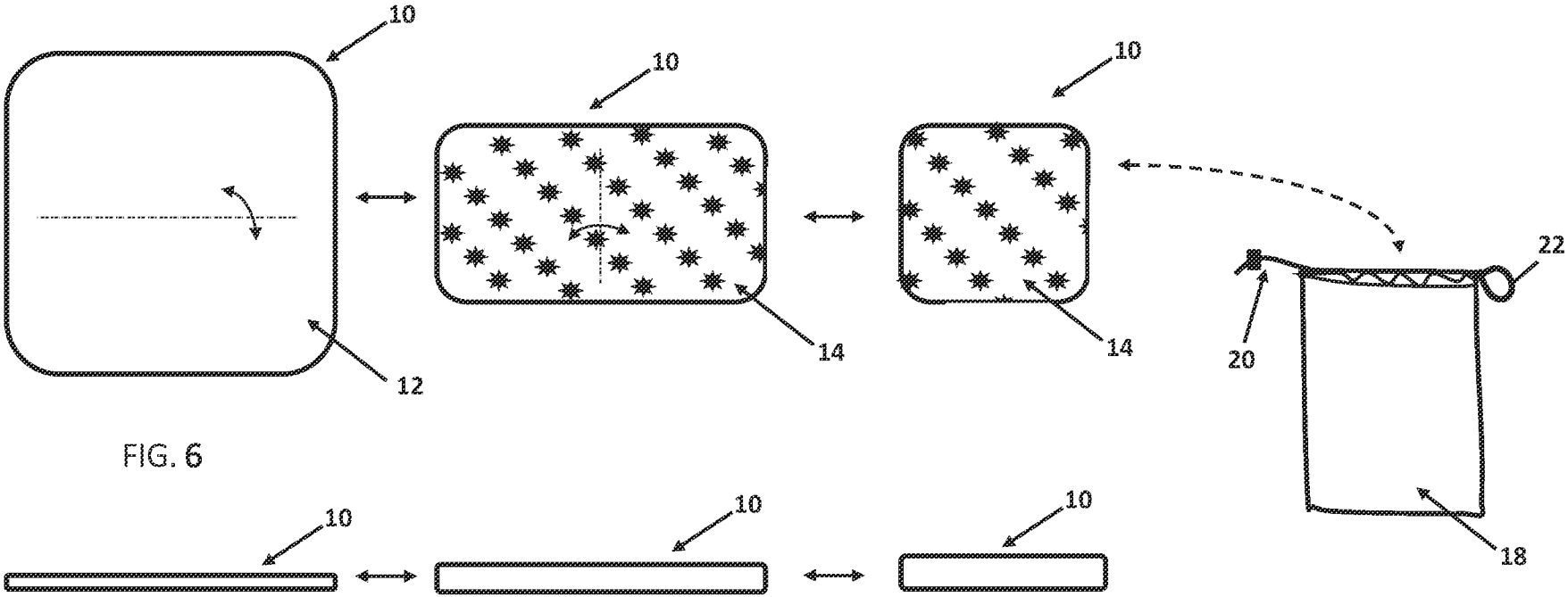
FIG. 6 illustrates a view of folding the seating surface barrier and inserting the barrier into a pouch for stowing and transporting the seating surface barrier.
FIG. 7 illustrates a side view of folding the seating surface barrier and inserting the barrier into a pouch for stowing and transporting the seating surface barrier.

As illustrated in FIGS. 6-7, the seating surface barrier 10 is foldable and/or condensable to fit into a pouch 18, where the pouch may be provided with a drawstring 20 or other closure for the pouch 18 and a clip 22 for securing the pouch to a purse, bag, or belt of the user for example. The pouch 18 may also have solid or printed design patterns, a QR code, or other detail thereon, in a material the same or different from the non-slip texture material 16 of the seating surface 12. The pouch may have dimensions smaller than the seating surface, for example, the pouch in which the seating surface can be stowed may have a width of less than 6 inches and a length of less than 6 inches. In one embodiment, the seating surface barrier 10 can be compactly folded to fit into a 4 inch by 4 inch pouch 18.

The seating surface barrier 10 may be provided in various sizes such that the seating surface may be used with average size seats as well as on benches and other non-traditional seating areas.

One or both of the seating surface and pouch may be comprised of a microfiber material or cloth, or a similar non-irritating and soft material such as blends of natural and synthetic textiles and fibers. The non-slip or areas of increased friction on the second side of the seating surface may be comprised of a non-slip material printed on or otherwise adhered to the second side. This non-slip material may comprise a silicone, rubber, polymer or other like material which provides a grip surface between the second side of the seating surface and the seat itself.

Although the present disclosure has been described with reference to preferred embodiments, workers skilled in the art will recognize that changes may be made in form and detail without departing from the spirit and scope of the disclosure.

The invention claimed is:

1. A portable, compact seating barrier comprising:

a single layer moisture wicking material having a first and second side wherein at least one of the first or second sides further comprises a non-slip texture layer on at least a portion thereof; and a hemmed, sewn, sealed, or finished perimeter edge, wherein the barrier has a first dimension that is in a range of approximately 18 inches to approximately 25 inches in length and a second dimension that is in a range of approximately 18 inches to approximately 25 inches in width and a thickness that is between 1/15 and 1/9 inch, wherein the moisture wicking material is microfiber and wherein the non-slip texture comprises silicon, and wherein the barrier is rollable into a rolled-up configuration to reduce an area of the barrier by at least ⅓ for compact stowage.

2. The seating barrier of claim 1, wherein the seating barrier is rectangular in overall shape and comprises smooth edges and rounded corners.

3. The seating barrier of claim 1, wherein the non-slip texture is printed in a spaced apart repeating pattern or abstract design such that the second side of the seating barrier has a non-flat surface topography.

4. The seating barrier of claim 1, wherein the second side comprises the non-slip texture on approximately 1% to 100% of a surface area of the second side.

5. The seating barrier of claim 4, wherein the second side comprises the non-slip texture on approximately 25% to 75% of the surface area of the second side.

6. A skin and clothing protector comprising:

a single layer microfiber material having a non-flat or textured back side further comprising a non-slip material layer for contacting a seating surface and retaining the protector thereon and a front side for contacting a user's skin and/or clothing, wherein the protector has dimensions sufficient to cover a horizontal surface area of the seating surface and a thickness between 1/15 and 1/9 inch, and wherein the protector is rollable into a rolled-up configuration to reduce an area of the protector by at least 1/30 for compact stowage.

7. The protector of claim 6 wherein the non-flat or textured back side comprises one or more areas of silicon configured to increase a co-efficient of friction between the microfiber material and the seating surface.

8. The protector of claim 7 wherein the skin and clothing protector is machine washable for re-use.

9. The protector of claim 8 wherein the protector prevents the user's skin or clothing from contacting the seating surface.

* * * * *